United States Patent [19]

Harvey

[11] 4,091,310

[45] May 23, 1978

[54] METHOD AND APPARATUS FOR ON-SWITCHING IN A CROSSED-FIELD SWITCH DEVICE AGAINST HIGH VOLTAGE

[75] Inventor: Robin J. Harvey, Thousand Oaks, Calif.

[73] Assignee: Hughes Aircraft Company, Culver City, Calif.

[21] Appl. No.: 797,720

[22] Filed: May 17, 1977

[51] Int. Cl.[2] ..... H01J 1/50

[52] U.S. Cl. ..... 315/344; 313/154; 313/157; 313/161

[58] Field of Search ..... 313/157, 154, 161; 315/344

[56] References Cited

U.S. PATENT DOCUMENTS

| | | | |
|---|---|---|---|
| 3,226,591 | 12/1965 | Josephson | 313/154 |
| 3,890,520 | 6/1975 | Lutz et al. | 313/157 |

*Primary Examiner*—Palmer C. Demeo

*Attorney, Agent, or Firm*—Allen A. Dicke, Jr.; W. H. MacAllister

[57] ABSTRACT

An auxiliary magnetic field coil is associated with the interelectrode space of a crossed-field switch device for ignition of the crossed-field switch device when high voltage is applied across the interelectrode space. The auxiliary magnetic field coil produces a localized field in which physical conditions cause conduction in the glow mode. Once conduction is started, the interelectrode voltage falls and with the main magnetic field applied to the entire effective interelectrode space, normal glow mode conduction takes place.

8 Claims, 6 Drawing Figures

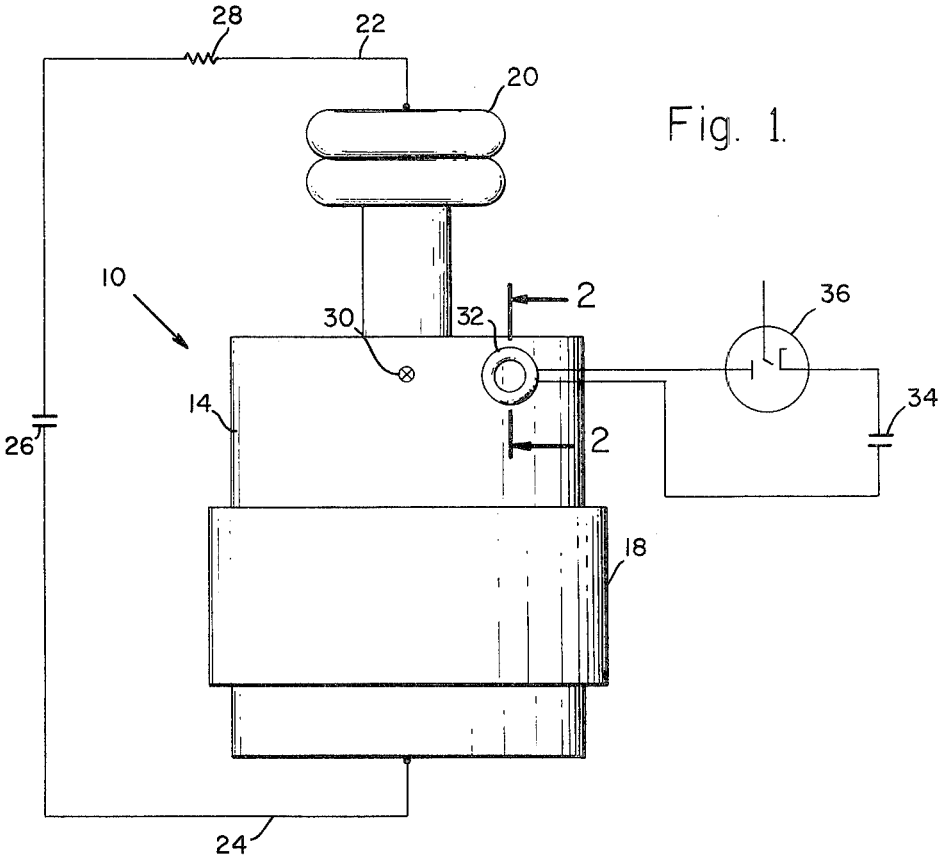
Fig. 1.
Fig. 2.
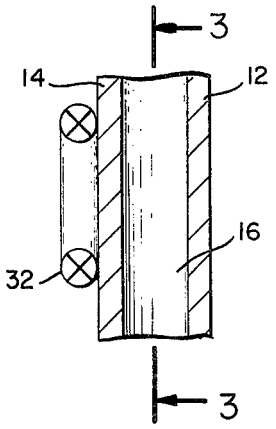
Fig. 3a.
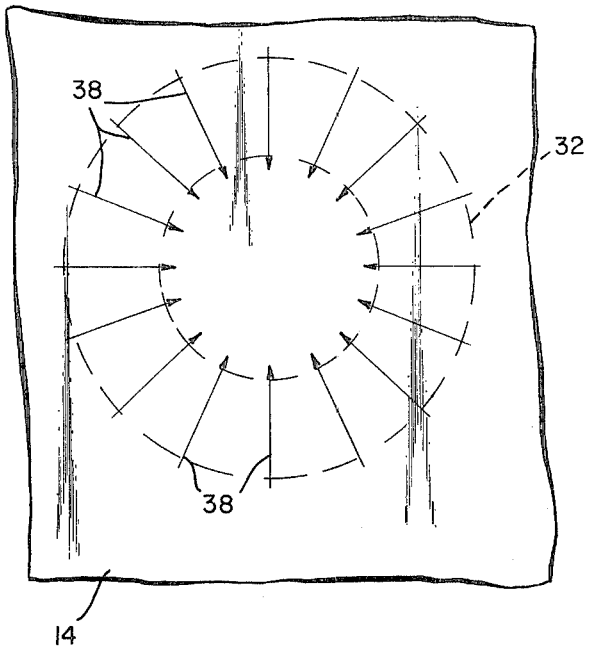

METHOD AND APPARATUS FOR ON-SWITCHING IN A CROSSED-FIELD SWITCH DEVICE AGAINST HIGH VOLTAGE

BACKGROUND OF THE INVENTION

This invention is directed to a crossed-field switch device, and in particular a method and apparatus for on-switching the crossed-field switch device when high voltage is applied thereto.

From the original Penning work on glow mode discharge in an interelectrode space where the magnetic field is at an angle to the electric field evolved the structure of U.S. Pat. No. 2,182,736. A considerable amount of development work has been done at the Research Laboratories of Hughes Aircraft Company to develop the crossed-field glow mode discharge into a switch device which is capable of off-switching large current against high voltage. The off-switching speed is so rapid that off-switching can occur between natural current zeros of the usual 60 cycle power line. When the off-switching device is very important for direct current off-switching, it is also applicable to rapid off-switching of power line alternating current between natural current zeros. General background along these lines is illustrated in G. A. G. Hofmann U.S. Pat. No. 3,604,977 as well as in H. E. Gallagher and W. Knauer U.S. Pat. No. 3,963,960.

In order to maintain a glow discharge in an interelectrode space, the path of an electron as it moves from one electrode to another through the gas in the interelectrode region must be sufficiently long that cascading ionization occurs. In other words, statistically each electron must have enough collisions to produce more than one ionizing collision. The maintenance of gas pressure and the lengthening of the electron path between the electrodes by the application of the crossed magnetic field is discussed in G. A. G. Hoffmann and R. C. Knechtli U.S. Pat. No. 3,558,960; M. A. Lutz and R. C. Knechtli U.S. Pat. No. 3,638,061; R. E. Lund and G. A. G. Hofmann U.S. Pat. No. 3,641,384; and G. A. G. Hofmann U.S. Pat. No. 3,769,537. Each of these patents shows the Paschen curve of voltage vs. the product *pd* where *p* is pressure and *d* is the interelectrode space. These curves are for a particular gas and zero magnetic field. The curves define regions between conductive and non-conductive conditions. They show that for a particular value of the product *pd*, the voltage at which breakdown into the glow mode occurs is at a minimum.

M. A. Lutz and G. A. G. Hofmann U.S. Pat. No. 3,678,289 discusses off-switching and discusses the characteristics of the glow mode discharge which permit off-switching. The patent shows in FIG. 3 a curve of the applied voltage across the interelectrode space vs. the magnetic field in the interelectrode space and shows the relationships of these parameters in which glow mode discharge does and does not occur, for fixed values of the product *pd* and for a particular gas. It is this V vs. B curve which shows the difficulty of on-switching when high-voltage is applied to the interelectrode space.

G. A. G. Hofmann U.S. Pat. No. 3,714,510 and M. A. Lutz and R. Holly U.S. Pat. No. 3,890,520 are both directed to on-switching of a crossed-field switch device by ionizing the gas in the interelectrode space. the application of ionization does not initiate a glow mode discharge and glow mode conduction when the initial conditions before the on-switching comprise a high interelectrode voltage and normal magnetic field. This is because the high interelectrode voltage captures electrons and draws them to the anode before the path length is sufficiently long to cause cascading ionization. The method of on-switching the crossed-field switch device of G. A. G. Hofmann U.S. Pat. No. 3,714,510 comprises the initiation of an interelectrode arc discharge to reduce the interelectrode potential, and after extinguishment of the interelectrode arc, the interelectrode potential is sufficiently low to initiate and permit conduction in the glow mode. The on-switching method of M. A. Lutz and R. Holly U.S. Pat. No. 3,890,520, while a high voltage is applied thereto, comprises the application of a sufficiently high over-all magnetic field to move the operating point to the right on the voltage vs. magnetic field curve to reach the conductive region even while the interelectrode voltage remains high.

This background illustrates the need for a method and apparatus for on-switching a crossed-field switch device during the application of high voltage to the electrodes, without arcing and without the need for a magnetic field source capable of very strong over-all magnetic fields.

SUMMARY OF THE INVENTION

In order to aid in the understanding of this invention it can be stated in an essentially summary form that it is directed to a method and apparatus for on-switching a crossed-field switch device against high voltage, the apparatus including an auxiliary magnetic field coil for producing a localized magnetic field in a localized region in the interelectrode space such that in the localized region the conditions are conductive in the glow mode, and the method comprises providing a localized region of glow mode conductivity so that the conditions in the main discharge space are changed so that glow mode discharge takes place through the entire effective conductive region.

It is thus an object of this invention to provide a method for on-switching a crossed-field switch device against high voltage, including the creation of a localized area in the interelectrode space where glow mode discharge takes place.

It is a further object to provide an apparatus for on-switching a crossed-field switch device into the glow mode against high voltage without the need for bringing the entire interelectrode space to an extra high magnetic field strength.

Other objects and advantages of this invention will become apparent from a study of the following portion of this specification, the claims and the attached drawings.

BRIEF DESCRIPTION OF THE DRAWINGS

FIG. 1 is a side elevational view of a crossed-field switch device having the apparatus of this invention for on-switching the crossed-field switch device against high voltage and for operation in accordance with the method of this invention.

FIG. 2 is an enlarged section with parts broken away taken generally along line 2—2 of FIG. 1.

FIG. 3*a* is a further enlarged view as seen in the direction 3—3 of FIG. 2 schematically showing the direction of the magnetic field lines resulting from the auxiliary magnetic field coil.

FIG. 3*b* is also a further enlarged view as seen in the direction of 3—3 of FIG. 2 schematically illustrating the character of the elongated electron paths while the auxiliary magnetic field is on.

FIG. 5 is a graph of V vs. B for fixed *pd* and particular gas pressure showing the various operating points of the switch device during turn-on.

DESCRIPTION OF THE PREFERRED EMBODIMENTS

Figure 5:
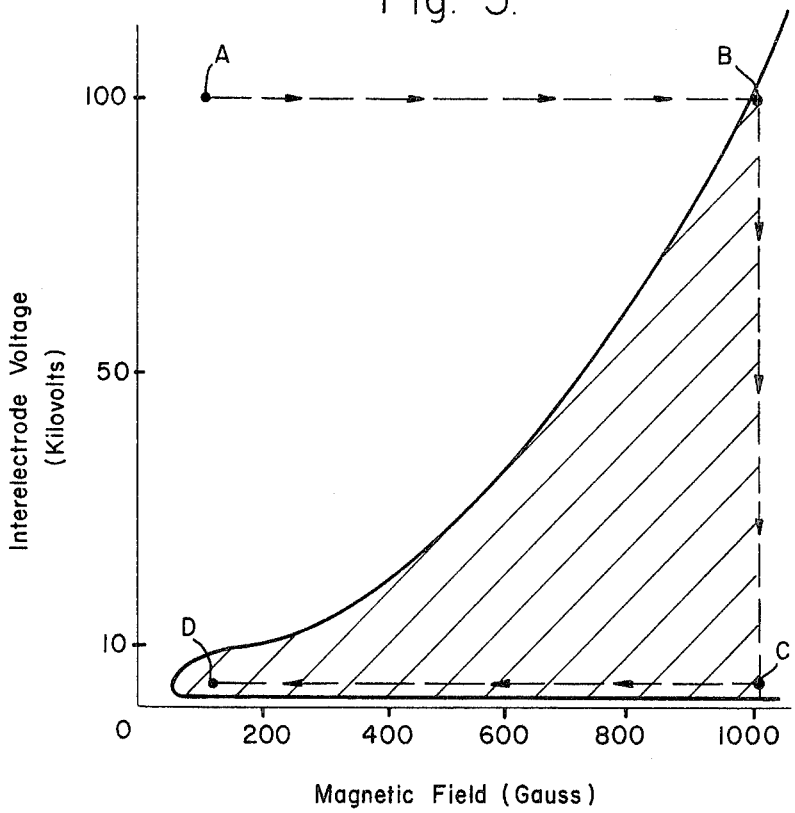

Crossed-field switch device 10 is illustrated in FIG. 1. It has anode 12 and cathode 14. Cathode 14 may form the outer physical structure of the crossed-field switch device and act as the vacuum envelope. Interelectrode space 16, see FIG. 2, has a radial interelectrode distance *d* and is filled with an appropriate gas at appropriate pressure. Main field coil 18 provides a magnetic field in the active area of the interelectrode space, that is the area generally covered by the area of the main field coil. Insulator tower 20 connects power line 22 to anode 12 while line 24 is connected to the cathode. A source of electric power can be connected to these lines so that it can be off-switched. In the present case, the power source is represented by charged capacitor 26 with its series resistance 28. For test purposes, a capacitor with a series current control resistor provides an adequate pulse. In the present case, capacitor 26 was charged to 100 kilovolts and resistor 28 was 550 ohms. With main field coil 18 providing 100 gauss in the effective area of the interelectrode space, conduction does not occur because the operating point is above the toe of the voltage vs. magnetic field strength curve at point A in FIG. 5. Ionization source 30, comprised of five millicuries of cesium 137 as a gamma and beta ray source provides initial ionization, but cascading breakdown of the gas in the interelectrode space does not occur because the electron path length is too short in the high potential field provided by the interelectrode voltage. The electrons are attracted to the anode before they statistically cause sufficient collisions for cascading ionizing breakdown. Thus, the crossed-field switch device is in a non-conductive condition even with the main magnetic field on.

Figure 3B:
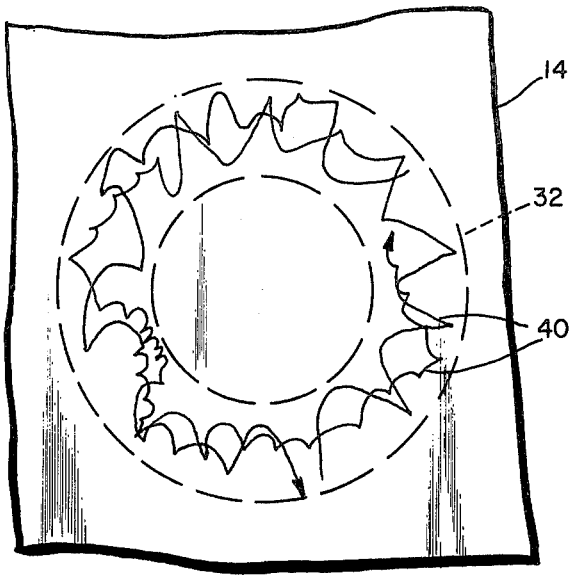

Auxiliary magnetic field coil 32 is an ignition coil for igniting glow mode discharge in a localized area in the crossed-field switch device 10 when the crossed-field switch device has an applied voltage. In the specific embodiment, the ignition magnetic field coil 32 is a 100 turn coil with 3½ inch diameter. It is supplied from capacitor 34 of 25 microfarad capacity and the capacitor is connected to the auxiliary magnetic field coil 32 through on-switching ignitron 36. Thus, when ignitron 36 is turned on, the capacitor 34 discharges through coil 32. The charge is sufficient to produce a local annular field under the coil in the interelectrode space of sufficient strength to place the local region of the interelectrode space under the coil at an operating point within the conduction region. In the present case, the magnetic field strength due to the auxiliary coil was approximately 1 kilogauss. The direction of the magnetic field resulting from this coil is schematically illustrated by field lines 38 in FIG. 3*a*. When the auxiliary magnetic field coil is turned on so that there is an ignition magnetic field in the interelectrode space, then the electron trajectories become elongated. Electron trajectories 40 are illustrated in FIG. 3*b* as an illustration of the generally circular path they take under the influence of the ignition magnetic field. The magnetic field is sufficiently strong to move the operating point in the localized area to point B in FIG. 5 to make the electron paths sufficiently long to cause sufficient ionizing collisions for cascading breakdown. Thus, glow discharge between the anode and cathode electrodes is initiated in this localized area. By using an annular coil, a relatively high magnetic field is produced in the neighborhood of the windings. By placing this close to the cathode of much larger dimensions, an effective electron trap is produced in the form of a toroid with a minimal amount of magnetic field energy. This circular trap has many properties equivalent to the effective area of a conventional crossed-field switch device with a diameter of the size of the coil. It is used in this case in parallel with a larger more standard magnetic field coil to perform the on-switching. Once conduction is achieved at the localized region of the auxiliary ignition magnetic field coil, point B in FIG. 5, the interelectrode voltage drops, point C, so that the operating conditions are such that cascading ionization takes place in the glow discharge mode for conduction. This is point D in FIG. 5. In this way, the standard discharge is initiated. The auxiliary magnetic field may be removed with no further effect. Transition from point B to point D is probably not rectangular, as shown, but remains in the conductive region.

Figure 4:
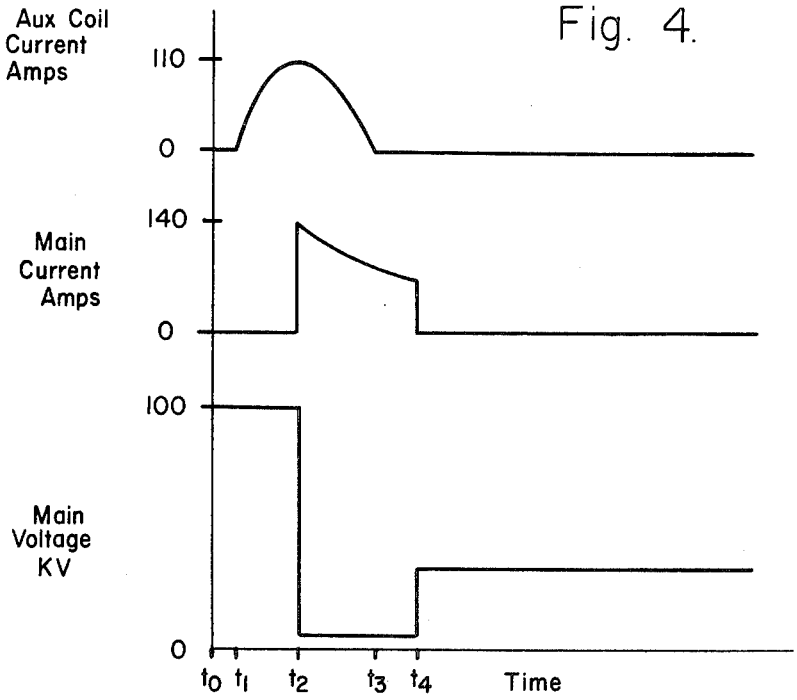
FIG. 4 is a graph showing auxiliary coil current, main conduction current and main voltage vs. time during on-switching of the crossed-field switch device by on-switching the auxiliary magnetic field coil and off-switching by bringing the main magnetic field below the critical value.

FIG. 4 illustrates an on-switching sequence. At time $t_o$, 100 kilovolts is applied to the electrodes. Main magnetic field coil 18 is on providing a main magnetic field in the effective interelectrode space of about 100 gauss with operating point at point A. The crossed-field switch device is nonconductive because these operating conditions are outside of the conductive region. At time $t_1$ on switching ignitron 36 is turned on to permit capacitor 34 to discharge through auxiliary field coil 32 to provide the ignition magnetic field. During this time the local operating point is moving from point A to point B. As seen in the top curve of FIG. 4, the auxiliary coil current rises and when the current reached about 100 amperes at time $t_2$ about 200 microseconds later, the ignition magnetic field coil was sufficiently high, at least 1 kilogauss, to move the local operating point into the conductive region and cause a local glow mode discharge under the auxiliary magnetic field coil. This glow mode discharge reduces the main interelectrode voltage, see the bottom curve in FIG. 4, to point C. The auxiliary coil current pulse expires at $t_3$ but the operating conditions remain in the conductive region and the device conducts as the operating point moves to point D, see the main conduction current in the middle curve of FIG. 4. The fact that the main conduction was occurring is apparent from the fact that the auxiliary coil current decreased quickly (before $t_3$) to a value below the value at which the conduction started so it was apparent that glow mode discharge was occurring at lower magnetic field strengths, in the effective region of the anode and cathode under the influence of the main field coil. At time $t_4$, about 300 microseconds after the beginning of main conduction, the main magnetic field was turned off to turn off the main conduction. This again proves that the conduction was in the main discharge region. The decrease in the main conduction current between $t_2$ and $t_4$ as well as the reduction in main voltage in that time is due to the discharge of the capacitor 26. If the power supply is infinite, the current would be maintained and the voltage would come back to 100 kilovolts with off-switching.

Previously, the ignition of a large diode-type crossed-field tube with high voltage applied thereto had not been considered as practical. In order to bring the operating point into a conductive condition, very large magnetic field strengths were required. To fill the active interelectrode region with the necessary magnetic field, at least 1 kilogauss, requires energy in the order of kilojoules. Even if this could be accomplished, the time involved in developing such a magnetic field would lead to on-switching time delays, and the time required to bring the interelectrode magnetic field below the critical value after such a large magnetic pulse would be long with the consequence that off-switching would be delayed. With the structure of the present example, the expenditure of only 6 joules of energy was required to initiate the glow discharge. By using the relatively small auxiliary magnetic field ignition coil the magnetic field may be made to reach the needed strength in a small volume with much less energy. The coil need not encircle the tube diameter and may be placed anywhere on the cathode wall. The coil need not have any special symmetry. Its shape and positioning need only be such that a closed electron path is produced in the interelectrode space in a position where the coil can produce ignition magnetic field strengths, for example, in the order of 1 kiloguass.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. The method of on-switching a crossed-field switch device having a closed path interelectrode space between two electrodes having a gas at reduced pressure therein and having a voltage impressed between the electrodes to cause an electric field between the electrodes, comprising the steps of:

impressing a main magnetic field in the interelectrode space around the entire closed path at an angle to the electric field at a value insufficient to cause cascading ionization and glow discharge around the entire closed path; and impressing a localized ignition magnetic field in a smaller area of the interelectrode space than the electric field and of sufficient strength to cause cascading ionization and glow discharge in the local region of the entire closed path thereof at an angle with respect to the ignition magnetic field so that the potential between the electrodes falls due to conduction through the ignition glow discharge to a point where glow discharge at the reduced potential and strength of the main magnetic field can take place in the main discharge region of the entire closed path interelectrode space.

2. The method of claim 1 wherein the ignition magnetic field is circular as caused by a toroidal field coil to induce a localized closed electron path in the interelectrode space shorter than the closed path in the main discharge region.

3. A crossed-field switch device comprising:

an anode;

a cathode spaced from said anode to define an interelectrode space therebetween and define a continuous closed path between said electrodes;

means for maintaining a gas at reduced pressure in said interelectrode space;

means for applying a main magnetic field in a portion of said interelectrode space in a direction at an angle to the minimum interelectrode direction and at an angle to the continuous closed path so that the main magnetic field extends around the closed path of said interelectrode space; and means for producing an auxiliary magnetic field in an adjacent portion of said interelectrode space of sufficient strength to cause cascading ionization glow discharge in a local portion of said interelectrode space so that electric conduction initiates in the local portion adjacent said auxiliary magnetic field means and between said anode and cathode to reduce applied interelectrode potential.

4. The apparatus of claim 3 wherein said means for producing an ignition magnetic field is an ignition electro-magnetic coil positioned adjacent one of said electrodes.

5. The apparatus of claim 4 wherein said ignition magnetic field coil is positioned so as to produce a closed path electron trapping magnetic field in said interelectrode space of a smaller dimension than said closed path interelectrode space.

6. The apparatus of claim 5 wherein said means for producing main magnetic field produces a field in said continuous closed path interelectrode space a magnetic field insufficient to cause conduction when voltage above a predetermined value is applied to said electrodes but is sufficient to cause cascading ionization and glow discharge when the applied voltage is below a predetermined value.

7. The apparatus of claim 6 wherein said auxiliary ignition magnetic field coil is toroidal.

8. The apparatus of claim 7 wherein said coil is positioned adjacent said cathode away from said main magnetic field coil to produce a local glow discharge adjacent said main magnetic field coil.

* * * * *

UNITED STATES PATENT AND TRADEMARK OFFICE

CERTIFICATE OF CORRECTION

PATENT NO. : 4,091,310

DATED : May 23, 1978

INVENTOR(S) : ROBIN J. HARVEY

It is certified that error appears in the above-identified patent and that said Letters Patent are hereby corrected as shown below:

In the Claims, Column 5, at the end of Line 49, add --entire closed path thereof at an angle with respect to the--

Column 5, Lines 52 and 53, cancel "entire closed path thereof at an angle with respect to the"

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*